US006766029B1

(12) United States Patent
Maisano

(10) Patent No.: US 6,766,029 B1
(45) Date of Patent: Jul. 20, 2004

(54) METHOD FOR ELECTRONICALLY SELECTING THE DEPENDENCY OF AN OUTPUT SIGNAL FROM THE SPATIAL ANGLE OF ACOUSTIC SIGNAL IMPINGEMENT AND HEARING AID APPARATUS

(75) Inventor: Joseph Maisano, Neuchatel (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/146,784

(22) Filed: Sep. 3, 1998

Related U.S. Application Data

(63) Continuation-in-part of application No. 08/893,325, filed on Jul. 16, 1997.

(51) Int. Cl.[7] ..... H04R 3/00
(52) U.S. Cl. ..... 381/313; 381/92
(58) Field of Search ..... 381/92, 312, 313, 381/320, 97; 367/119, 125

(56) References Cited

U.S. PATENT DOCUMENTS

| | | | | |
|---|---|---|---|---|
| 4,017,859 A | * | 4/1977 | Medwin | 342/383 |
| 4,751,738 A | | 6/1988 | Widrow et al. | |
| 5,539,859 A | | 7/1996 | Robbe et al. | |
| 5,581,620 A | * | 12/1996 | Brandstein et al. | 381/92 |

FOREIGN PATENT DOCUMENTS

| | | |
|---|---|---|
| EP | 557166 | 8/1993 |
| EP | 652686 | 5/1995 |
| JP | 5-79899 | 3/1993 |
| JP | 05-218803 | 8/1993 |
| JP | 05-284591 | 10/1993 |
| JP | 06-083371 | 3/1994 |
| JP | 06-189395 | 7/1994 |
| JP | 07-015787 | 1/1995 |
| JP | 07-240991 | 9/1995 |
| JP | 08-101693 | 4/1996 |
| JP | 07-018578 | 7/1996 |
| JP | 09-149489 | 6/1997 |

OTHER PUBLICATIONS

English abstract of Japanese Patent No. 5–79899.

* cited by examiner

*Primary Examiner*—Minsun Oh Harvey
*Assistant Examiner*—Brian Pendleton
(74) *Attorney, Agent, or Firm*—Pearne & Gordon LLP

(57) ABSTRACT

An acoustical beam former is proposed with at least two acoustical/electrical converters ($2_a$, $2_b$) in a predetermined physical distance. The mutual phasing of the output signals of the two converters is detected (27) and is multiplied by a constant or frequency-dependent factor. In dependency (46, 48) from multiplied phasing and from at least one of the output signals of the converters ($2_a$, $2_b$) there is generated an electric output signal which has a dependency from spatial impinging direction of acoustical signals to the converters ($2_a$, $2_b$), as if the two converters were located at a virtual distance from each other which is different and especially considerably larger than the real physical distance they are mutually located.

25 Claims, 6 Drawing Sheets

METHOD FOR ELECTRONICALLY SELECTING THE DEPENDENCY OF AN OUTPUT SIGNAL FROM THE SPATIAL ANGLE OF ACOUSTIC SIGNAL IMPINGEMENT AND HEARING AID APPARATUS

The present application is a continuation-in-part of co-pending application Ser. No. 08/893,325 filed Jul. 16, 1997.

The present invention is generically directed on a technique according to which acoustical signals are received by at least two acoustical/electrical converters as e.g. by multidirectional microphones, respective output signals of such converters are electronically computed by an electronic transducer unit so as to generate an output signal which represents the acoustical signals weighted by a spatial characteristic of amplification. Thus, the output signal represents the received acoustical signal weighted by the spatial amplification characteristic as if reception of the acoustical signals had been done by means of e.g. an antenna with an according reception lobe or beam. Thus, the present invention is generically directed on an electronically preset, possibly electronically adjusted and tailored reception "lobe".

Figure 1:
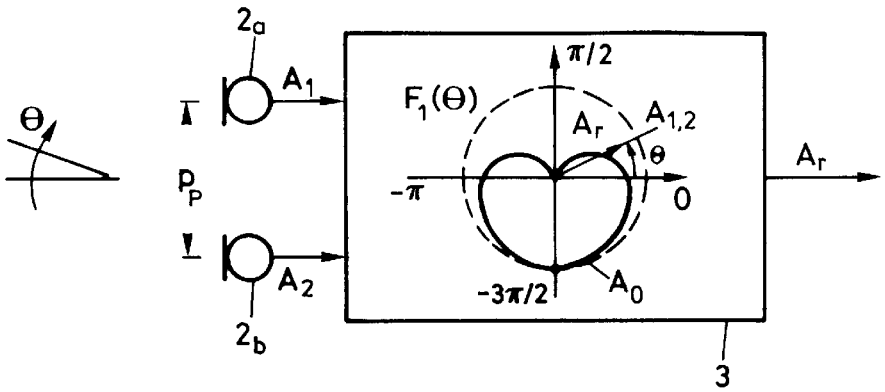

FIG. 1 most generically shows such known technique for such "beam forming" on acoustical signals. Thereby, at least two multidirectional acoustical/electrical converters $\mathbf{2}_a$ and $\mathbf{2}_b$ are provided, which both—per se—convert acoustical signal irrespective of their impinging direction θ and thus substantially unweighted with respect to impinging direction θ into first and second electrical output signals $A_1$ and A2. The output signals $A_1$ and $A_2$ are fed to an electronic transducer unit 3 which generates from the input signals $A_1$, $A_2$ an output signal $A_r$. As shown within the block of unit 3 the signals $A_{1,2}$ are treated to result in the result signal $A_r$ which represents either of $A_1$ or $A_2$, but additionally weighted by the spatial amplification function $F_1(\theta)$. Thus, acoustic signals may selectively be amplified dependent from the fact under which spatial angle θ they impinge, i.e. under which spatial angle the transducer arrangement 2*a*, 2*b*"sees" an acoustical source. Thereby, such known approach is strictly bound to the physical location and intrinsic "lobe" of the converters as provided.

Figure 2:
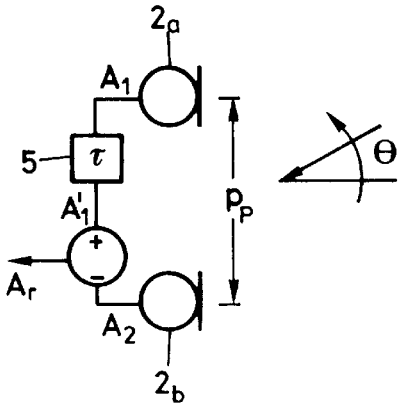

One approach to perform signal processing within transducer unit 3 shall be exemplified with the help of FIG. 2. Thereby, all such approaches are based on the fact that due to a predetermined mutual physical distance $p_p$, of the two converters $\mathbf{2}_a$ and $\mathbf{2}_b$, there occurs a time-lag dt between reception of an acoustical signal at the converters $\mathbf{2}_a$, $\mathbf{2}_b$.

Considering a single frequency—ω—acoustical signal, received by the converter $\mathbf{2}_a$, this converter will generate an output signal $$A_1 = A \cdot \sin \omega t, \tag{1}$$

whereas the second transducer $\mathbf{2}_b$ will generate an output signal according to $$A_2 = A \cdot \sin \omega(t+dt), \tag{2}$$

whereat dt is given by $$dt = \frac{p_p \sin\theta}{c} \tag{3}$$

therein, c is the sound velocity.

By time-delaying e.g. $A_1$ by an amount $$\tau = p_p / c \tag{4}$$

and forming the result signal $A_r$ from the difference of time-delayed signal $A_1'$—as a third signal—namely from $$A_1' = A \cdot \sin \omega(t+\tau), \text{ and} \tag{5}$$

$$A_2 = A \cdot \sin \omega(t+dt), \tag{2}$$

there results, considered at the frequency ω, a spatially cardoid weighted output signal $A_r$ as shown in the block of transducer unit 3:

$$|A_r| = |A_1' - A_2| = 2A \sin(\omega(\tau - dt)/2) = 2A \sin(\omega(\tau - p_p * \sin\theta/c)/2). \tag{6}$$

At θ=90° $A_r$ becomes zero and
at θ=−90° $A_r$ becomes $$A_{rmax} = 2A \sin \omega p_p / c. \tag{7}$$

Figure 3:
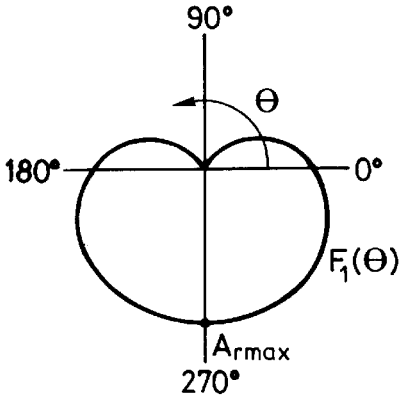

Such processing of the output signals of two omnidirectional order converters leads to a first order cardoid weighing function $F_1(\theta)$ as shown in FIG. 3. By respectively selecting converters with higher order acoustical to electrical conversion characteristic i.e. "lobe" and/or by using more than two converters, higher order—m—weighing functions $F_m(\theta)$ may be realised.

Figure 4:
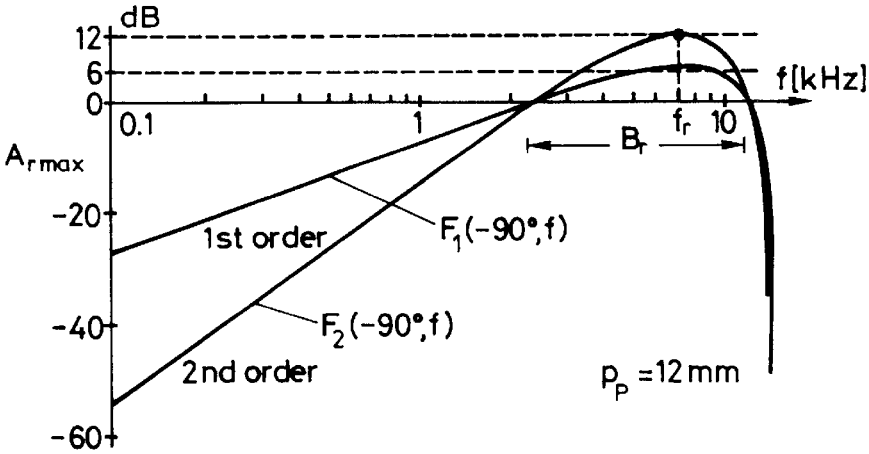

In FIG. 4 there is shown the amplitude $A_{rmax}$-characteristic, resulting from first order cardoid weighing as a function of frequency f=ω/2π. Additionally, the respective function for a second order cardoid weighing function $F_2(\theta)$ is shown. Thereby, there is selected a physical distance $p_p$ of the two converters $\mathbf{2}_a$ and $\mathbf{2}_b$ of FIG. 1 to be 12 mm.

As may clearly be seen at a frequency $f_r$ which is $$f_r = c/(4p_p) \tag{8}$$

maximum amplification occurs of +6 dB at the first order cardoid and of +12 dB at a second order cardoid. For $p_p$=12 mm, $f_r$ is about 7 kHz.

From FIG. 4 a significant roll-off for low and high frequencies with respect to $f_r$ is recognised, i.e. a significant decrease of amplification.

Techniques for such or similar type of beam forming are e.g. known from the U.S. Pat. No. 4,333,170—acoustical source detection—, from the European patent application 0 381 498 directional microphone—or from Norio Koike et al., "Verification of the Possibility of Separation of Sound Source Direction via a Pair of Pressure Microphones", Electronics and Communications in Japan, Part 3, Vol. 77, No. 5, 1994, page 68 to 75.

Irrespective of the prior art techniques used for such beam forming with at least two converters, the distance $p_p$ is an important entity as may be seen e.g. from formula (8) and directly determines the resulting amplification/angle dependency.

Formula (8) may be of no special handicap if such a technique is used for narrow band signal detection or if no serious limits are encountered for geometrically providing the at least two converters at a large mutual physical distance $p_p$.

Nevertheless, and especially for hearing aid applications, the fact that $f_r$ is inversely proportional to the physical distance $p_p$ of the transducers is a serious drawback, due to the fact that for hearing aid applications the audio frequency band up to about 4 kHz for speech recognition should be detectable by the at least two transducers which further should be mounted with the shortest possible mutual distance $p_p$. These two requirements are in contradiction: The lower $f_r$ shall be realised, the larger will be the distance $p_p$ required.

It is thus a first object of the present invention to remedy the drawbacks encountered with respect to $p_p$-dependency of known acoustical "beam forming".

The first object of the present invention is reached by providing a method for electronically selecting the dependency of an electric output signal of an electronic transducer unit from spatial direction wherefrom acoustical signals impinge on at least a first and a second acoustical/electrical converter, connected to the inputs of said transducer unit, thereby inputting first and second electric signals thereto, which comprises the steps of generating at least one third electric signal in dependency from mutual phasing of the first and the second electric signals, said phasing being multiplied by a constant or a frequency-dependent factor and further from a fourth electric signal which depends from at least one of the first and the second electric signals;

generating the output signals of the transducer unit in dependency of the third signal and further from a fifth electric signal which is dependent from at least one of the first and the second electric signals.

Thereby, it becomes possible, irrespective of the actual physical mutual distance of the two converters, to select said dependency, thereby pre-selecting same and possibly tuning and adjusting same, to result in a dependency as if the at least two converters were physically arranged at completely different physical positions than they really are.

In a first preferred manner of realising the inventive method the fourth electric signal is selected to be linearly dependent only from one of the first and second electric signals, thereby being preferably directly formed by such first or second electric signal.

Nevertheless, in a today's more preferred manner of realising the inventive method, the fourth electric signal is dependent on both first and second electric signals. In a preferred form the fourth electric signal has a predetermined or adjustable "lobe" characteristic, i.e. dependency from spatial impinging direction. Thereby in a preferred form of "lobe" realisation the fourth electric signal is generated by delaying one of the first and second signals and then summing the delayed signal and the other, undelayed signal of said first and second signals. Thereby, the fourth electric signal per se has an amplification to impinging angle dependency and thus defines—as was said—for a "lobe", as an example according to a dependency as was discussed with the help of the FIGS. 1 to 4.

In a further preferred form of realising the inventive method, either per se or combined with either method to generate the fourth signal as just stated, and especially combined with generating the fourth signal with a "lobe"-characteristic, it is proposed to generate the fifth electric signal in direct or linear dependency of at least one of the first and second electric signals, thereby preferably using one the said first and second electric signals as the fifth electric signal.

Thereby, and again per se or combined with either method of generating the fourth electric signal, especially combined with generating the fourth electric signal with a "lobe"-dependency, it is proposed to generate the fifth electric signal as well with a "lobe" dependency from spatial impinging angle, which is realised in a first form by delaying one of the first and second signals and summing the delayed signal and the other of said first and second signals. Thereby, it becomes clear that the fourth electric signal, generated to define for a "lobe" characteristic, may directly be used as the fifth electric signal, having then the same "lobe"-characteristic.

In a further, clearly preferred realisation form of the inventive method and combined with any of the preferred realisation forms stated up to now and throughout the further description, it is proposed to generate the first and second electric signals in their respective spectral representation, thereby generating the at least one third electric signal in dependency of mutual phasing of respective spectral components of the first and second signals and multiplied by a constant frequency-independent or by frequency-dependent factors.

In a further preferred mode of operation, the frequency-dependent multiplication factors are selected to be inversely proportional to frequency, at least in a first approximation.

With an eye specifically on hearing aid applications, wherefore the present method is most suited, but may be clearly applied to others, it is proposed that the real physical distance of the first and second converters to be at most 20 mm, whereby the virtual distance, which is at least dependent from the phasing multiplication factor, is selected to be larger than the mutual physical distance of the two converters, in other words dependency of the transducer unit's output signal from spatial angle becomes so as if, physically, converters were provided at considerably larger mutual distances than they really are. It goes without saying, that such technique is of very high advantage in any space-restricted applications, as especially in hearing aid applications.

To resolve the object mentioned above and to realise especially a hearing aid, whereat, irrespective of the physical position of at least two acoustical/electrical converters, a desired reception lobe may be tailored and possibly adjusted according to the needs, is realised inventively by an acoustical/electrical transducer apparatus comprising at least two acoustical/electrical converters spaced from each other by a predetermined physical distance, whereby the at least two converters generate, respectively, first and second electrical output signals and wherein the outputs of said acoustical/electrical converters are operationally connected to an electronic transducer unit, which generates an output signal dependent from said first and second output signals of said converters by an amplification function which function is dependent from spatial angle under which said converters receive acoustical signals, comprising:

a phase difference detection unit, the inputs thereof being operationally connected to the outputs of said converters and generating at its output a phase difference-dependent signal, a phase processing unit, one input thereof being operationally connected to the output of said phase difference-detection unit, at least one second input of said processing unit being operationally connected to a factor-value-selecting source, a third input of said phase processing unit being operationally connected to at least one of the inputs of said at least two converters, said phase processing unit generating an output signal at its output according to a signal at said third input with a phasing according to a signal at said one input and at said at least one second input, a beam-former processing unit with at least two inputs, one input being operationally connected to the output of said phase-processing unit, the second input being operationally connected to at least one output of said at least two con- verters.

Under all the aspects of the invention there is thus possible to realise $$p_V > p_p. \tag{9}$$

This especially for low-space applications, as especially for hearing aid applications.

Thereby, there is introduced the virtual distance $p_V$ of transducers, i.e. the distance of converters which would have to be physically realised to get an angle dependency as realised inventively.

Thereby, according to formula (8), $f_r$ may be shifted to lower frequencies:

It becomes possible to realise $f_r$ values well in the audiofrequency band for speech recognition (<4 kHz) with physical distances of microphones, which are considerably smaller than this was possible up to now.

Multiplying the phase difference by a constant factor does nevertheless not affect the roll-off according to FIG. 4. This roll-off is significantly improved, leading to an enlarged frequency band $B_r$ according to FIG. 4 if—as was said—the predetermined function of frequency is selected as a function which is at least in a first approximation inversely proportional to the frequency of the acoustic signal.

For instance for the first order cardoid according to FIG. 3 and FIG. 4, there may be reached a flat frequency characteristic between 0,5 and 4 kHz and thus a significantly enlarged frequency band $B_r$ with well-defined roll-offs of amplification at lower and higher frequencies by accordingly selecting the frequency dependent function to be multiplied with the phase difference.

Figure 5:
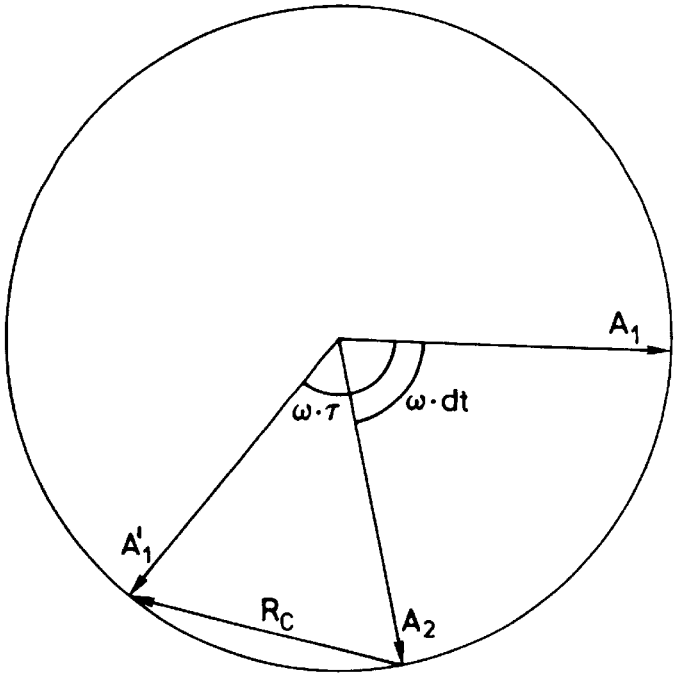
Figure 6:
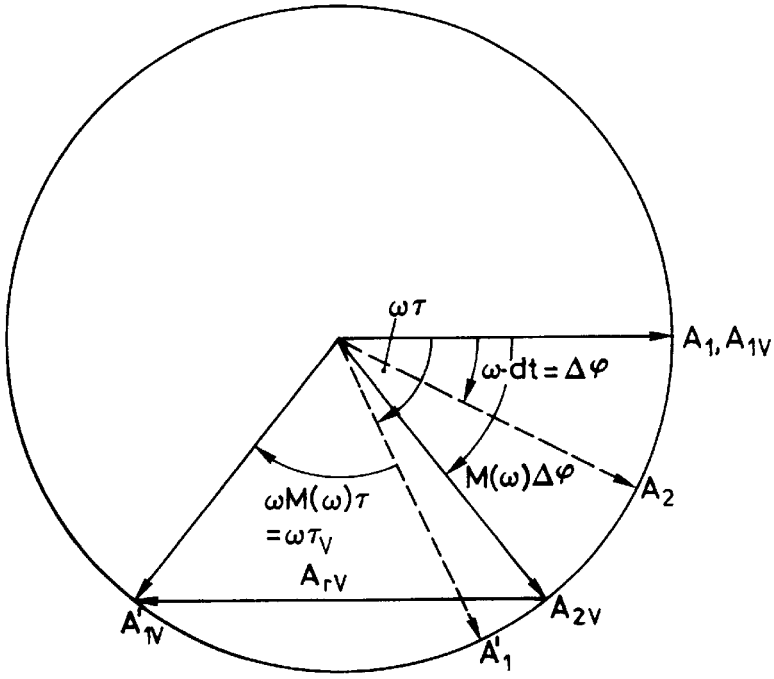
Figure 7:
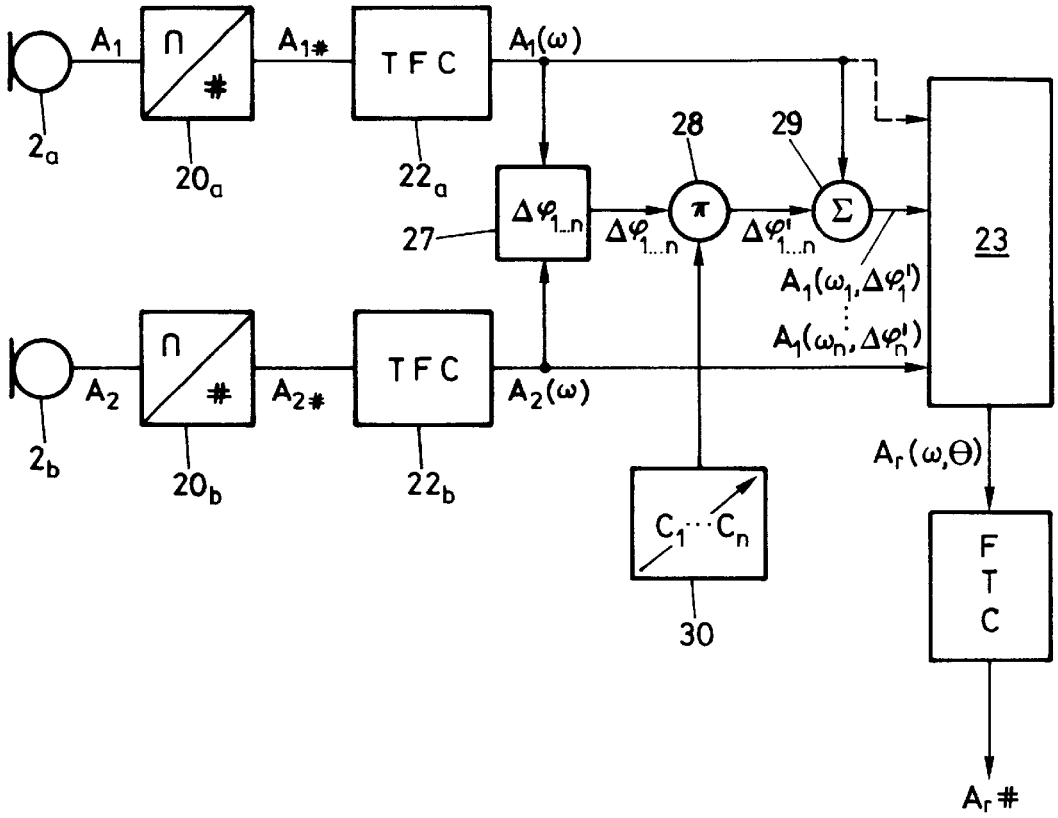
Figure 8:
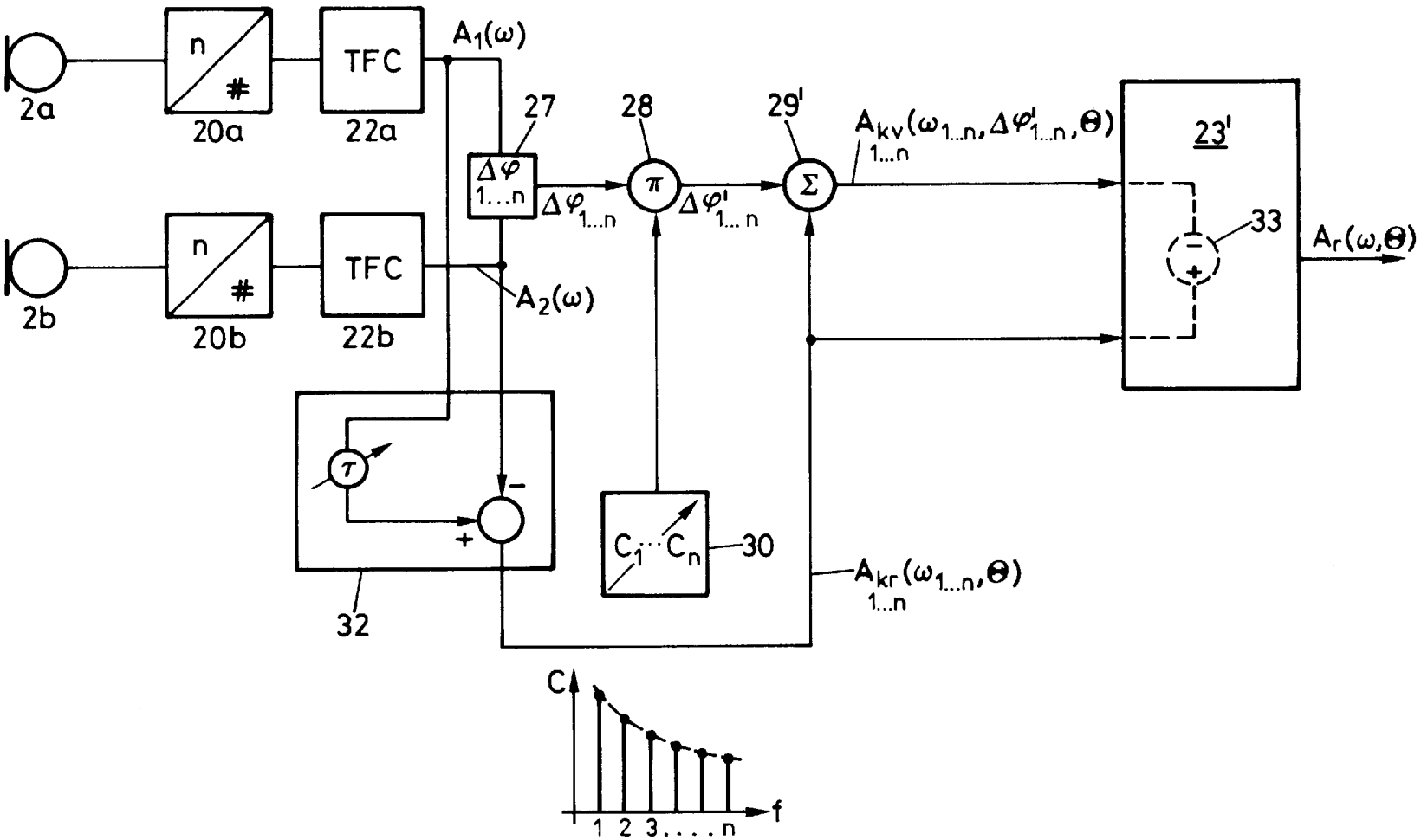
Figure 9:
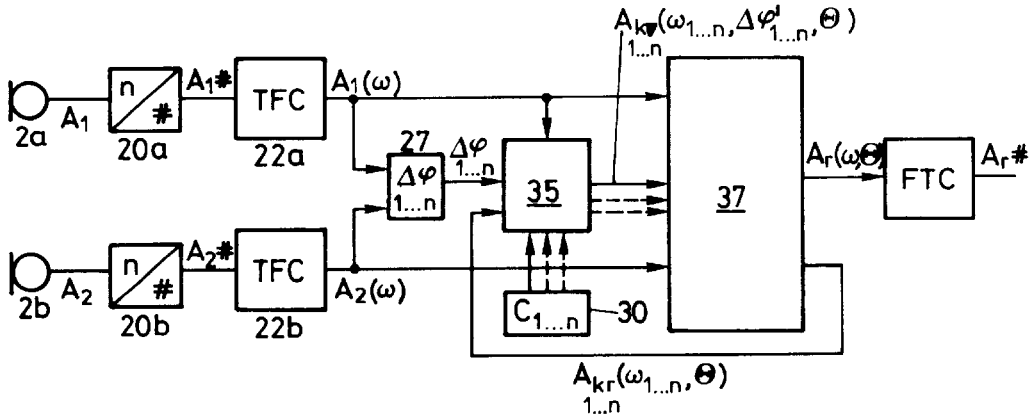
Figure 10:
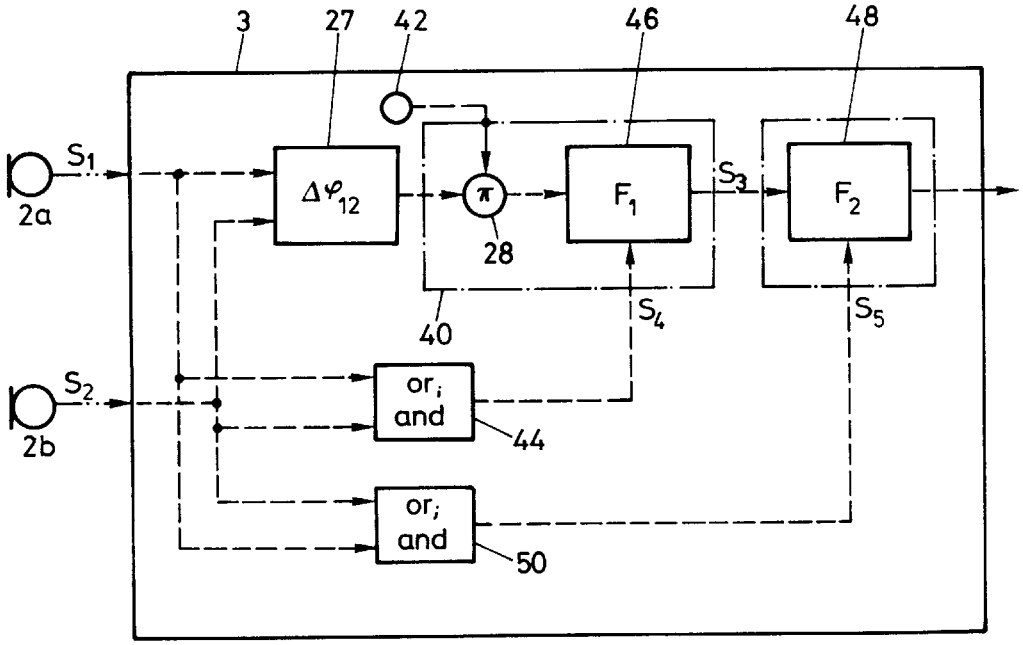
Figure 11:
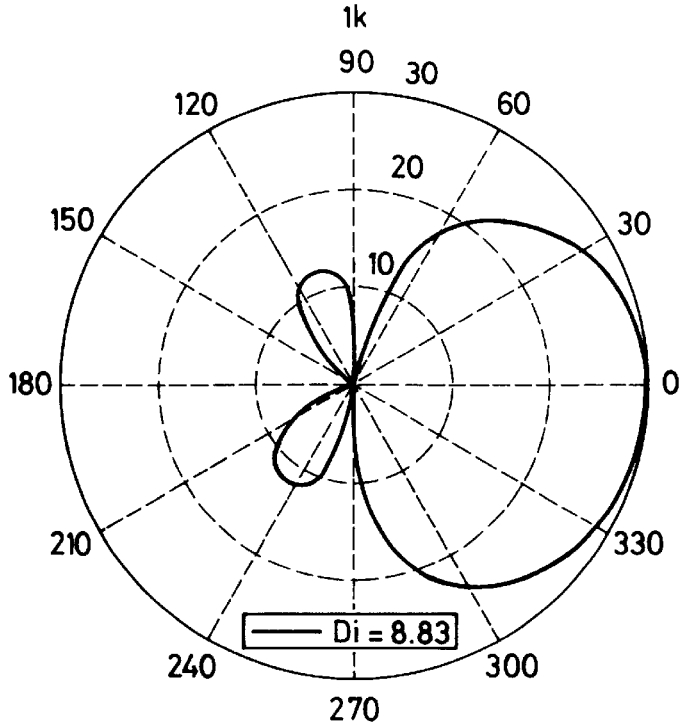
Figure 12:
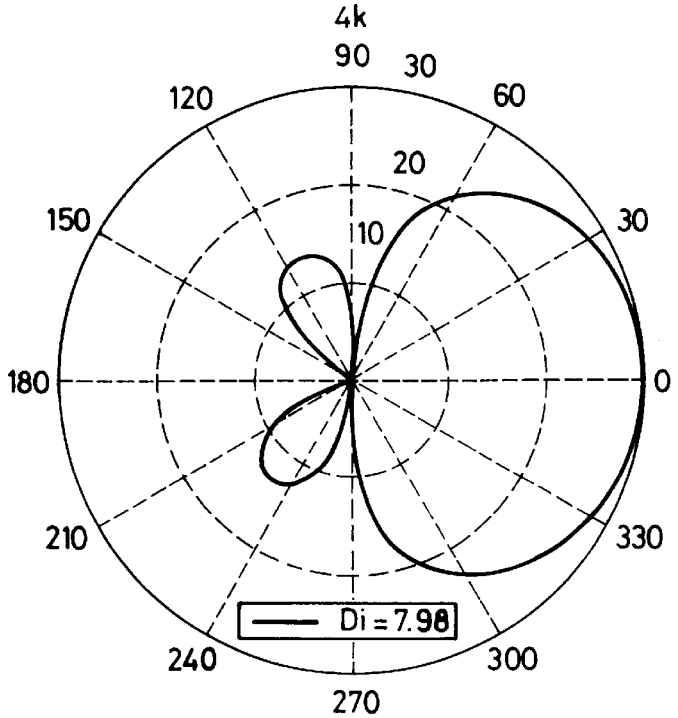

Other objects of this invention will become apparent as the description proceeds in connection with the accompanying drawings, of which show:

FIG. 1: A functional block diagram of a two-transducer acoustic receiver with directional beam forming according to prior art;

FIG. 2: one of prior art beam forming techniques as may be incorporated in the apparatus of FIG. 1, shown in block diagram form;

FIG. 3: a two-dimensional representation of a three-dimensional cardoid beam, i.e. amplification characteristic as a function of incident angle of acoustical signals;

FIG. 4: the frequency dependency of the maximum amplification value according to FIG. 3 for first and second order cardoid functions;

FIG. 5: a pointer diagram resulting from the technique according to FIG. 2, still prior art;

FIG. 6: a pointer diagram based on FIG. 5 (prior art), but according to the inventive method, which is performed by an inventive apparatus;

FIG. 7: a simplified block diagram of a first realisation form of an inventive apparatus, especially of an inventive hearing aid apparatus, wherein the inventive method is implemented;

FIG. 8: a simplified block diagram of a today preferred realisation form of the inventive method and apparatus;

FIG. 9: a simplified block diagram of an inventive apparatus, operating according to the inventive method, in a generalised form;

FIG. 10: a generic signal-flow/functional block diagram of an inventive apparatus operating according to the inventive method;

FIG. 11: the measured directivity characteristics resulting from the inventive method and inventive apparatus according to FIG. 8;

FIG. 12: a second directivity characteristics in a representation according to FIG. 11, resulting from the inventive method and apparatus according to FIG. 8.

As was mentioned above, in the FIGS. 1 to 4 known beam forming techniques were based on at least two acoustical/electrical transducers spaced from each other and directly on their mutual physical distance $p_p$.

In FIG. 5 there is shown a pointer diagram according to (6).

The basic idea of the present invention shall be explained now with the help of the still simplified one—ω—frequency example. The inventively realised pointer diagram is shown in FIG. 6. The phase difference ω·dt between signal $A_2$ and $A_1$ according to FIG. 6 is $$\omega \cdot dt = \omega \cdot \frac{p_p \sin\theta}{c} = \Delta\varphi. \tag{10}$$

This phase difference is determined and is multiplied by a value dependent from frequency, thus with the respective value of a function M(ω), which may be also a constant $M_0 \neq 1$.

By phase shifting one of the two signals $A_1$, $A_2$ according to the respective pointers in FIG. 6, e.g. of $A_2$ by $$M_\omega \cdot \Delta\phi \text{ or by } M_0 \cdot \Delta\phi,$$

there results the phase shifted pointer $A_{2V}$. This pointer would have also occurred if dt had been larger by an amount according to $M_\omega$ or $M_0$, thus if a "virtual transducer" had been placed distant from transducer $\mathbf{1}_a$ by the virtual distance $p_V$, for which:

$$P_V = M_\omega \cdot p_p \text{ or} \tag{11}$$

$$P_V = M_0 \cdot p_p. \tag{12}$$

As we consider one single frequency for simplicity we may write $M_0 = M_\omega$.

With virtual $\tau_V$ $$\tau_V = M_\omega \cdot \tau \text{ and} \tag{13}$$

$$dt_v = M_\omega \cdot p_p \frac{\sin\theta}{c} \tag{3$_v$}$$

we get according to the present invention:

$$A_1 = A_{1V} = A \sin \omega t \tag{1$_V$}$$

$$A_{2V} = A \sin \omega(t + dt_V) = A \sin \omega(t + M_\omega dt) \tag{2$_V$}$$

$$A_{1V} = A \sin \omega(t + M_\omega \tau) \tag{5$_V$}$$

$$A_{rV} = 2A \sin((M_\omega \cdot \omega(\tau - dt)/2) \tag{6$_V$}$$

With (8) we further get:

$$f_{rV} = \frac{c}{4\, M_\omega p_p} = \frac{1}{M_\omega} \cdot f_r.$$

Therefrom, we may see that for a given $p_p$, which would lead to a too high $f_r$, $f_{rV}$ is reduced by the factor $M_\omega$, taken $M_\omega > 1$.

In FIG. 7 there is schematically shown a first preferred realisation form of an inventive apparatus in a simplified manner, especially for implementing the inventive method into an inventive hearing aid apparatus. Thereby, the output signals of the acoustical/electrical transducer $\mathbf{2}_a$ and $\mathbf{2}_b$ are fed to respective analogue to digital converters 20*a*, 20*b*, the outputs thereof being input to time domain to frequency domain—TFC—converter units as to Fast-Fourier Transform units 22*a* and 22*b*. A spectral phase difference detecting unit 27 spectrally detects phase difference $\Delta\phi_n$ for all n spectral frequency components which are then multiplied by a set of constants $c_n$. If M is a function of ω, $M_\omega$, then the $c_n$ can be different for different frequencies, and represent a frequency dependent function or factor. If on the other hand the phase differences $\Delta\phi_n$ are multiplied by the same $c_0=c_n\neq 1$ this accords with using a constant $M_0$.

This multiplication according to ($3_V$) is done at a spectral multiplication unit 28. Signal $A_1$ in its spectral representation is then spectrally phase shifted at a spectral phase shifter unit 29 by the multiplied spectral phase difference signals output by multiplier unit 28.

According to FIG. 7 the signal $A_1$ in its spectral representation and inventively, spectrally phase shifted—$A_1(\omega, \Delta\phi'_n)$—is computed in a spectral computing unit 23 together with $A_2$ in its spectral representation, as if transducer 2*a* was distant from transducer 2*b* by a distance $p_V=M_\omega p_p$. The resulting spectrum is transformed back by a frequency to time domain converter—FTC—as by an Inverse-Fast-Fourier-Transform unit 24 to result in $A_{r\#}$.

Thereby, other beam forming techniques than that described with the help of FIGS. 1 to 4, i.e. using the time delaying technique—transformed in the frequency domain—may be used in unit 23.

Nevertheless the time delaying technique is preferred.

With an eye on FIG. 4 it has been explained that by inventively introducing "virtual" converters with a virtually enlarged mutual distance, it becomes possible to shift the high gain frequency $f_r$ towards lower frequencies, which is highly advantageous especially for hearing aid applications. This is already reached if instead of a frequency dependent function $M_\omega$, a constant $M_0$ is multiplied with the phase difference as explained.

In a preferred mode of the invention the frequency dependent function $M_\omega$ is selected to be, at least in a first approximation, $$M_\omega \sim \frac{1}{\omega} \tag{14}$$

Thereby, it is reached that, different from FIG. 4, there will be no roll-off and the gain in target direction will be constant over the desired frequency range. By appropriately selecting the function $M_\omega$ it is e.g. possible to reach a flat characteristic within a predetermined frequency range, e.g. between 0.5 and 4 kHz with defined roll-offs at lower and higher frequencies. With appropriately selecting the function $M_\omega$ practically any kind of beam forming can be made.

For generating higher order cardoid weighing functions it is absolutely possible to additionally use the not phase-shifted output signal $A_1$—as shown in FIG. 7 by dotted line—as computing input signal to unit 23 too, thus "simulating" three converters.

FIG. 8 shows a today's preferred embodiment of an inventive apparatus in a functional-block/signal-flow representation in analogy to the representation of FIG. 7. Blocks and signals which were already explained with the help of FIG. 7 are defined in FIG. 8 by the same reference numbers.

The phase spectrum at the outside of multiplication unit 28, $\Delta\phi'_{1\ldots n}$ is added at a summing unit 29' to a signal $A_{kr,1\ldots n}(\omega,\theta)$, also in spectral representation, which signal has a preselected dependency from impinging angle θ, as especially a first or higher order cardoid dependency.

To realise that signal $A_{kr,1\ldots n}(\omega_{1\ldots n},\theta)$ and following the explanation with respect to FIGS. 2 to 4, the output signal $A_1(\omega)$, and $A_2(\omega)$ in their spectral representation, are led to a beam-former unit 32, which may be integrated in beam-former unit 23' and which e.g. is built up according to the beam-former of FIG. 2. Thereby, it must be clearly stated that instead of the beam-former 32 as shown in FIG. 8 other kinds of beam-former resulting in different than first order cardoid characteristics may be implemented there.

The spectrum $A_{kr,1\ldots n}(\omega_{1\ldots n},\theta)$ is then phase-shifted by the phase adding unit 29' by $\Delta\phi'_{1\ldots n}$, resulting in an output signal of that unit 29' which is the spectrum $A_{kv,1\ldots n}(\omega_{1\ldots n},\Delta\phi'_{1\ldots n},\theta)$ as shown in FIG. 8. The signal $A_{kr,1\ldots n}(\omega_{1\ldots n},\theta)$ as well as the output signal of summing unit 29' are led to the beam-former unit 23', where they are preferably again summed as shown at 33.

At the output of beam-former unit 32 a signal is generated with a real cardoid dependency from impinging angle θ, whereas at the output of unit 29', and thus after phase shifting, a dependency function with respect to impinging angle θ is realised according to virtually positioned converters. When summing, as with the unit 33 within beam-former unit 23', there results a dependency of the output signal $A_r$ from impinging angle θ according to a second order cardoid if the real cardoid dependency at the output of unit 32 is a first order cardoid.

Thus, in a more generic representation, as shown in FIG. 9, the phase difference spectrum at the output of unit 27 is subjected to a phase shifter unit 35, where it is modified as per $c_1$ to $c_n$.

The generalised phase shifter 35 may receive directly one of the output signals of one of the two converters 2*a*, 2*b* and/or a signal which results from beam forming from the said converter output signals to be phase shifted. In FIG. 9 this is represented by the signal path fed back from beam former 37 to the phase shifter 35. This feedback accords, with an eye on FIG. 8, to the signal path between beam former 32 and summing unit 29'. According to FIG. 9 beam former unit 32 of FIG. 8 is integrated in the overall beam former unit 37.

The beam former 37 in its generalised form of FIG. 9 receives at least one of the output signals of the converters 2*a*, 2*b* and the output signal of the generalised phase shifter 35.

It is evident for the skilled artisan that more than two real converters may be used and/or more than one $M_\omega$ function or of $c_0$ or $c_{1\ldots n}$ sets may be used to produce more than one "virtual transducer" signal from one or from more than one real converter signals respectively.

With selecting the number of physical and virtual converters, their characteristics and virtual "relocation" of these converters, the spatial weighing function may be selectively tailored.

The present invention under its principal object makes it possible to realise practically any desired beam forming with at least two converters separated by only a predetermined small distance, due to the fact that electronically there is provided a virtual mutual converter location of the physically provided converter.

Thereby, roll-off may be significantly reduced by such virtual transducer, which is especially established with realising a virtual distance of the converter which is dependent from frequency, especially inversely dependent. By selecting a frequency-$M_\omega$-dependent virtual distance of the converters, virtually an array of frequency-selective converters is established. For a hearing aid apparatus the real distance between the at least two transducers, i.e. microphones, is selected to be 20 mm at most, preferably less.

FIG. 10 shows in most generic form the principle proceeding and apparatus structure as according to the present invention and common to all embodiments of the invention as described above.

First and second electric signals $S_1$ and $S_2$, which are derived from the output signals of the at least two acoustical/electrical converters $\mathbf{2}_a$, $\mathbf{2}_b$, are input to the transducer unit 3.

Within unit 3, there is provided a phase difference detection unit according to unit 27 of FIGS. 7, 8 or 9. The phase difference detection unit 27 has respective inputs which are operationally connected to the inputs of unit 3 and thus to the outputs of the converters 2*a*, 2*b*. The output of the phase difference detection unit 27 is operationally connected to an input of a phase processing unit 40 shown in dashed-dotted lines in FIG. 10. The phase processing unit has a second input, which is connected to a factor value-selecting source 42, generating a constant or frequency-dependent factor h. A third input of the phase processing unit is operationally connected as schematically shown by combining unit 44 in an "AND" or in an "EX-OR" dependency to respective outputs of the at least two converters $\mathbf{2}_a$ and $\mathbf{2}_b$. The phase processing unit 40 generates an output signal, $S_3$, in accordance with a signal, $S_4$, applied to the third input of the processing unit 40 and in accordance with the signals applied to the first—from 27—and second—from 42—inputs to the phase processing unit.

The signal at the first input of the phase processing unit, which is operationally connected to the output of the phase difference detection unit, is multiplied—by unit 28—by the constant or frequency-dependent factor, and, at a signal combining unit 46, the output signal of the processing unit, signal $S_3$, is thus generated in dependency from mutual phasing of the output signals of the converters, multiplied by a constant or frequency-dependent factor and from signal $S_4$ as applied to the third input of the processing unit 40, which latter signal $S_4$ is dependent from at least one of the output signals of the converters $\mathbf{2}_a$, $\mathbf{2}_b$. In unit 46 the dependency $F_1$ of signal $S_3$ from both, signal $S_4$ and multiplied phasing signal as at the output of unit 28, is generated.

The signal $S_3$, which accords to $A_1(\omega)$ of FIG. 7 or to $A_{k,1\ldots n}(\omega_{1\ldots n},\theta)$ of FIGS. 8 and 9, is input to a beam former processing unit 48 according to unit 23 or 23' or 37, as of the FIGS. 7 to 9. The beam former processing unit comprises a second input to which $S_5$, dependent from at least one of the output signals of the converters $\mathbf{2}_a$, $\mathbf{2}_b$ is fed. Latter signals are thus operationally connected as schematically shown by block 50 in an "EX-OR" or in an "AND" combination to the beam former processing unit 48.

In FIG. 11 there is shown the "lobe" or directivity characteristic—in dB—which was measured at an inventive apparatus according to FIG. 8 at single frequency 1 kHz of acoustical signals impinging on the two acoustical/electrical converters $\mathbf{2}_a$, $\mathbf{2}_b$. In this apparatus there was valid:

converters $\mathbf{2}_a$, $\mathbf{2}_b$: omnidirectional microphones, KNOWLES EK 7263

Physical distance $p_p$: 12 mm $\tau$: 35 $\mu$sec.

c: 2 at 1 kHz and at 4 kHz

There resulted a directivity index as defined in SPEECH COMMUNICATION 20 (1996), 229 to 240, Microphone array systems for hands-free telecommunication, Gary W. Elco of 8.83.

In FIG. 12 the result is shown at an inventive apparatus which was used for the measurement according to FIG. 11, but at 4 kHz single frequency acoustical impinging signals. The directivity index became 7.98.

There results from proceeding according to FIG. 8 a directivity characteristics according to a second order cardoid. This would conventionally have to be realised by means of four acoustical/electrical converters as of $\mathbf{2}_a$ and $\mathbf{2}_b$, which four converters define for a spacing of 24 mm between respective two of the four converters. Thus, it might be seen that with the inventive method and apparatus with only two acoustical/electrical converters with a mutual spacing of 12 mm a directivity result is reached as if four acoustical/electrical converters had been used with mutual spacing of 24 mm.

What is claimed is:

1. A method for electronically selecting the dependency of an electric output signal of an electronic transducer unit from spatial direction, wherein acoustical signals impinge on at least a first and a second acoustical/electrical converter operationally connected to an input of said transducer unit and thereby input first and second electrical signals to said transducer unit, comprising the steps of:

generating at least one third electrical signal dependent on a signal representing a phase difference between said first and second electric signals multiplied by a non-unitary constant or a frequency-dependent factor, and being further dependent on a fourth electrical signal which is dependent on at least one of said first and second electrical signals;

generating said output signal of said transducer unit dependant on said third electrical signal and a fifth electrical signal which is dependent on at least one of said first and second electrical signals.

2. The method of claim 1, further comprising the step of generating said fourth electrical signal as a signal dependent from said first or second electrical signal.

3. The method of claim 1, further comprising the step of generating said fourth electrical signal as dependent from said first and said second electrical signals.

4. The method of claim 1, further comprising the step of generating said fourth electrical signal as a signal having a predetermined or adjustable dependency on said spatial direction.

5. The method of claim 1, further comprising the step of generating said fourth electrical signal by delaying one of said first and second electrical signals and summing the delayed signal and the other of said first and second electrical signals.

6. The method of claim 1, further comprising the step of generating said fifth electrical signal, as being dependent from one of said first and second electrical signals.

7. The method of claim 1, further comprising the step of generating said fifth electrical signal as dependent from both said first and said second electrical signals.

8. The method of claim 1, further comprising the step of generating said fifth electrical signal as a signal with a predetermined or adjustable dependency on said spatial direction.

9. The method of claim 1, further comprising the step of generating said fifth electrical signal by delaying one of said first and of said second electrical signals and summing said delayed signal and the other of said first and second electrical signals.

10. The method of claim 1, comprising the further step of generating said fourth electrical signal from said fifth electrical signal.

11. The method of claim 1, comprising the further steps of generating said first and second electrical signals in their respective spectral representation and generating said at least one third electrical signal in dependency of mutual phasing of respective spectral components of, said first and second electrical signals, multiplied by said factor and in dependency of said fourth electrical signal.

12. The method of claim 1, comprising the further step of selecting said factor as inversely proportional to frequency.

13. An acoustical/electrical transducer apparatus comprising at least two acoustical/electrical converters spaced from each other by a predetermined physical distance, said at least two converters generate, respectively, first, and second electrical output signals, outputs of said acoustical/electrical converters are operationally connected to an electronic transducer unit which generates an output signal dependent from said first and second output signals of said converters by an amplification function, said function is dependent from spatial angle under which said converters receive acoustical signals, comprising:

a phase difference detection unit, inputs of said phase difference detection unit being operationally connected to the outputs of said converters, said detection unit generating at an output a phase difference-dependent signal, a phase processing unit, one input of said phase processing unit being operationally connected to the output of said phase difference detection unit, at least one second input of said processing unit being operationally connected to a factor-value selecting source, a third input of said phase processing unit being operationally connected to at least one of the outputs of said at least two converters, said phase processing unit generating an output signal at its output according to a signal at said third input with a phasing according to a signal at said one input and at said at least one second input, a beam-former processing unit with at least two inputs, one input being operationally connected to the output of said phase-processing unit, the second input being operationally connected to at least one output of said at least two converters.

14. The apparatus of claim 13, wherein said factor value selecting source generates a signal having a constant or frequency-dependent value.

15. The apparatus of claim 13, wherein said third input of said phase-processing unit is operationally connected to one output of said at least two converters.

16. The apparatus of claim 13, wherein said third input of said phase-processing unit is connected to an output of a beam former unit, inputs of said beam former unit being operationally connected to the outputs of said at least two converters.

17. The apparatus of claim 16, wherein said beam former unit comprising a summing unit, one input of said summing unit being operationally connected to an output of one of said at least two converters, another input of, said summing unit being operationally connected via a time-delay unit, to the output of the other of said at least two converters.

18. The apparatus of claim 13, wherein said second input of said beam former processing unit is operationally connected to one of said at least two converters.

19. The apparatus of claim 13, wherein said second input of said beam-former processing unit is operationally connected to the output of a summing unit, one input of said summing unit being connected via a time-delaying unit to the output of one of said at least two converters, a second input of said summing unit being operationally connected to the output of said second one of said at least two converters.

20. The apparatus of claim 13, wherein the outputs of said at least two converters are operationally connected to inputs of a further summing unit, one thereof via a time-delay unit, the output of said further summing unit being operationally connected to said third input of said phase processing unit and to said second input of said beam-former processing unit.

21. The apparatus of claim 13, wherein the outputs of said at least two converters are generated via respective analogue to digital converters and time domain to frequency domain transform units, said phase-difference detection unit, said phase-processing unit and said beam-former processing unit operating in frequency domain, the output of said transducer unit being generated via a frequency domain to time domain conversion unit.

22. The apparatus of claim 13, wherein when said apparatus is a hearing aid apparatus, said at least two converters having a mutual physical distance of at most 20 mm.

23. A method for electronically selecting the dependency of an electric output signal of an electronic transducer unit from spatial direction, wherein acoustical signals impinge on at least a first and a second acoustical/electrical converter operationally connected to an input of said transducer unit and thereby input first and second electrical signals to said transducer unit, comprising the steps of:

generating at least one third electrical signal in dependency on a signal representing a phase difference between said first and second electrical signals multiplied by a frequency-dependent factor;

generating said output signal of said transducer unit dependent on said third electrical signal and a fifth electric signal which is dependent on at least one of said first and second electrical signals.

24. The method of claim 4, wherein said dependency on said spatial direction is of a cardioid manner.

25. The method of claim 8, wherein said dependency on said spatial direction is of a cardioid manner.

* * * * *

UNITED STATES PATENT AND TRADEMARK OFFICE

CERTIFICATE OF CORRECTION

PATENT NO. : 6,766,029 B1
DATED : July 20, 2004
INVENTOR(S) : Joseph Maisano

It is certified that error appears in the above-identified patent and that said Letters Patent is hereby corrected as shown below:

Column 2,
Lines 12, 22, 31 and 38, please delete “cardoid”, and insert therefor -- cardioid --.

Column 5,
Lines 23, 40 and 44, please delete “cardoid”, and insert therefor -- cardioid --.

Column 7,
Lines 50 and 64, please delete “cardoid”, and insert therefor -- cardioid --.

Column 8,
Lines 15, 21, 22 and 23, please delete “cardoid”, and insert therefor -- cardioid --.

Column 10,
Lines 2-3, please delete “cardoid”, and insert therefor -- cardioid --.

Signed and Sealed this

Eleventh Day of January, 2005

JON W. DUDAS
*Director of the United States Patent and Trademark Office*